US011428421B2

(12) United States Patent
Hirawa et al.

(10) Patent No.: US 11,428,421 B2
(45) Date of Patent: Aug. 30, 2022

(54) OUTDOOR UNIT OF REFRIGERATION APPARATUS

(71) Applicant: Daikin Industries, LTD., Osaka (JP)

(72) Inventors: Daiki Hirawa, Osaka (JP); Fumiaki Koike, Osaka (JP); Shigeki Kamitani, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/627,413

(22) PCT Filed: Jul. 24, 2018

(86) PCT No.: PCT/JP2018/027714
§ 371 (c)(1),
(2) Date: Dec. 30, 2019

(87) PCT Pub. No.: WO2019/026693
PCT Pub. Date: Feb. 7, 2019

(65) Prior Publication Data

US 2020/0149752 A1 May 14, 2020

(30) Foreign Application Priority Data

Jul. 31, 2017 (JP) ..... JP2017-148427

(51) Int. Cl.
*F24F 1/56* (2011.01)
*F24F 1/22* (2011.01)
*F24F 1/38* (2011.01)

(52) U.S. Cl.
CPC ..... *F24F 1/56* (2013.01); *F24F 1/22* (2013.01); *F24F 1/38* (2013.01)

(58) Field of Classification Search
CPC ..... F24F 1/56; F24F 1/22; F24F 1/38; E06B 1/04; E06B 3/04; E06B 3/7007;
(Continued)

(56) References Cited

U.S. PATENT DOCUMENTS

2003/0217563 A1 11/2003 Wendt et al.
2016/0187006 A1 6/2016 Koo et al.
(Continued)

FOREIGN PATENT DOCUMENTS

CN 1308210 A 8/2001
CN 1952501 A 4/2007
(Continued)

OTHER PUBLICATIONS

English Translation CN 102422104B (Year: 2009).*
(Continued)

*Primary Examiner* — David J Teitelbaum
(74) *Attorney, Agent, or Firm* — Osha Bergman Watanabe & Burton LLP

(57) ABSTRACT

An outdoor unit of a refrigeration apparatus includes: a fan that generates an upward flow of air passing through a heat exchanger; an electric component box that accommodates a group of electric components; and a casing that includes a panel disposed at a predetermined position opposite to the electric component box. The panel is divided into at least a first panel and a second panel in a lateral direction as viewed from a front view of the panel. The first panel is opposed to at least part of the electric component box. The first panel is detachable from the casing while the second panel remains attached to the casing.

15 Claims, 9 Drawing Sheets

(58) Field of Classification Search
CPC .. E06B 2003/7049; E06B 7/16; E06B 7/2312; E06B 3/362; F25D 23/063
See application file for complete search history.

(56) References Cited

U.S. PATENT DOCUMENTS

| | | | | |
|---|---|---|---|---|
| 2016/0195343 | A1* | 7/2016 | Jeung | F24F 1/50 165/162 |
| 2017/0030597 | A1 | 2/2017 | Crespo-Calero | |
| 2017/0248331 | A1 | 8/2017 | Nezu et al. | |

FOREIGN PATENT DOCUMENTS

| | | | |
|---|---|---|---|
| CN | 102422104 | A | 4/2012 |
| CN | 102901311 | A | 1/2013 |
| CN | 103393293 | A | 11/2013 |
| EP | 2792955 | A1 | 10/2014 |
| EP | 2840326 | A1 | 2/2015 |
| EP | 3182023 | A1 | 6/2017 |
| GB | 2360840 | A | 10/2001 |
| JP | S48069555 | U | 9/1973 |
| JP | S59103179 | U | 7/1984 |
| JP | H08128677 | A | 5/1996 |
| JP | H09126495 | A | 5/1997 |
| JP | 2007163017 | A | 6/2007 |
| JP | 2007263386 | A | 10/2007 |
| JP | 2008202889 | A | 9/2008 |
| JP | 2009-079870 | A | 4/2009 |
| JP | 2009068743 | A | 4/2009 |
| JP | 2010077689 | A | 4/2010 |
| JP | 5565072 | B2 | 8/2014 |
| JP | 2017053578 | A | 3/2017 |
| JP | 2017155968 | A | 9/2017 |
| KR | 20160081718 | A | 7/2016 |

OTHER PUBLICATIONS

Notification of Reasons for Refusal issued in corresponding Japanese Patent Application No. 2017-148427, dated Oct. 23, 2018, with translation (14 pages).

International Preliminary Report on Patentability issued in corresponding International Application No. PCT/JP2018/027714, dated Feb. 4, 2020, with translation (11 pages).

International Search Report issued in corresponding International Application No. PCT/JP2018/027714, dated Oct. 23, 2018, with translation (5 pages).

Extended European Search Report issued in corresponding European Patent Application 18841795.0 dated Nov. 16, 2020 (7 pages).

* cited by examiner

RELATIONSHIP BETWEEN FORM OF OUTDOOR HEAT EXCHANGER AND FORM OF FRONT PANEL

OUTDOOR UNIT OF REFRIGERATION APPARATUS

TECHNICAL FIELD

The present invention relates to an outdoor unit of a refrigeration apparatus, and particularly, to an outdoor unit that blows air upward from a top surface.

BACKGROUND

In an outdoor unit of a refrigeration apparatus that blows air upward, specifically, an outdoor unit of an air conditioner as described in Patent Literature 1 (JP 2007-263386 A), a service person performs maintenance or the like after detaching a panel screwed to a casing at a position opposite to an electric component box when accessing the electric component box, for example, at a time of initial setting or maintenance after installment.

However, the panel as described above, which is wide and heavy and has both ends surrounded by supports of a casing, is not easy to detach and requires a lot of workload.

PATENT LITERATURE

[Patent Literature 1] JP 2007-263386 A

SUMMARY

One or more embodiments of the present invention provide an outdoor unit of a refrigeration apparatus that facilitates detachment of a panel, for example, at a time of accessing an electric part, such as an electric component box.

An outdoor unit of a refrigeration apparatus according to one or more embodiments of the present invention includes a fan, an electric part, and a casing. The fan generates a flow of air passing through a heat exchanger and blows the air upward. The electric part accommodates a group of electric components. The casing includes a panel. The panel is disposed in a predetermined position opposite to the electric part. Further, the panel is divided into at least first and second panels in a lateral direction in a front view. The first panel is opposed to at least part of the electric part. The first panel is detachably attached while the second panel remains attached to the casing.

In this outdoor unit, since the panel is divided into the first and second panels, a service person for initial setting or maintenance can detach only the first panel from the casing while the second panel remains attached to an original position of the casing when accessing the electric part. As a result, the service person can access the electric part while only the first panel is detached. Further, a conventional configuration needs detachment of a plurality of panels, increases a total weight of the panels though reducing a weight of each panel, and increases the number of panels to complicate a detaching method. However, this outdoor unit eliminates the need for such a complicated detaching method, saves operation time, and improves work efficiency.

In an outdoor unit of a refrigeration apparatus according one or more embodiments of the present invention, a width of at least part of the first panel is equal to or wider than a width of the electric part as viewed from a side of the first panel.

In this outdoor unit, only detaching the first panel from the casing allows for access to the electric part. This improves work efficiency at a time of initial setting and maintenance after installment.

In an outdoor unit of a refrigeration apparatus according to one or more embodiments of the present invention, the first panel includes first and second regions having different height positions and widths. The first region is located above the second region, and a width of the first region is wider than a width of the second region.

In this outdoor unit, a downward-facing surface or an inclined surface is formed at a position shifting from the first region having a wide width to the second region having a narrow width. This surface functions as a handle for lifting the first panel.

In an outdoor unit of a refrigeration apparatus according to one or more embodiments of the present invention, the first panel includes an inclined part that makes the width of the first panel narrower as the height position goes down in a front view.

This outdoor unit, which has an inclined part that faces obliquely downward, enables the service person to lift the first panel by hooking a finger onto the inclined part to detach the first panel from the casing, and thus improves work efficiency.

In an outdoor unit of a refrigeration apparatus according to one or more embodiments of the present invention, at least part of the first panel overlaps the second panel.

In this outdoor unit, when detaching the first panel from the casing, it is easier for the service person to lift the first panel by inserting a finger into a gap where the first and second panels do not overlap each other than by gripping a part where the first and second panels overlap each other. Specifically, a recess including an "overlapping part" and a "non-overlapping part" of the first and second panels is formed, and the service person inserts a finger into the "non-overlapping part" of the recess to grip part of the recess. As a result, work efficiency is improved.

In an outdoor unit of a refrigeration apparatus according to one or more embodiments of the present invention, the first panel includes a flat part that faces vertically downward or obliquely downward.

This outdoor unit enables the service person to lift the first panel by hooking a finger onto the flat part that faces vertically downward or obliquely downward to detach the first panel from the casing, and thus improves work efficiency.

In an outdoor unit of a refrigeration apparatus according to one or more embodiments of the present invention, the casing further includes a support disposed in at least one corner. In a front view of the casing, an end of the first panel is on a same plane as an outer contour plane of the support or laterally projects from the outer contour plane.

In a conventional outdoor unit, which has the end of the panel surrounded by the supports, the service person cannot grip but pull out the end of the panel with a pad of a finger, and cannot easily detach the panel from the casing.

In this outdoor unit, the end of the first panel is located on the same plane as the outer contour plane of the support or laterally projects from the outer contour plane, so that the service person can grip the end of the panel and easily detach the panel from the casing.

In an outdoor unit of a refrigeration apparatus according to one or more embodiments of the present invention, the casing further includes a support disposed in at least one corner. The end of the first panel is opposed to a corner of the support with a predetermined gap between each other.

This outdoor unit ensures a space for hooking a finger onto the end of the first panel to detach the first panel from the casing, and thus allows the service person to easily grip the first panel.

In an outdoor unit of a refrigeration apparatus according to one or more embodiments of the present invention, the first panel includes a side end part that extends in a depth direction.

This outdoor unit enables the service person to lift the first panel by hooking a finger onto the side end part to detach the first panel from the casing, and thus improves work efficiency.

In an outdoor unit of a refrigeration apparatus according to one or more embodiments of the present invention, the first panel includes a hook part that hooks onto the casing.

This outdoor unit prevents erroneous assembling because the hook part functions for positioning of the first panel.

In an outdoor unit of a refrigeration apparatus according to one or more embodiments of the present invention, each of a plurality of panels including the first panel includes a hook part that hooks onto the casing. Further, each panel has a different arrangement of the hook part.

This outdoor unit prevents erroneous assembling by having a different arrangement of the hook parts for positioning at the time of attachment, for example, a different space in-between, because there may be erroneous assembling when the different panels have similar forms.

Since the panel is divided into first and second panels, the outdoor unit of a refrigeration apparatus according to one or more embodiments of the present invention enables the service person for initial setting or maintenance to detach only the first panel from the casing while the second panel remains attached to the original position of the casing when the service person accesses the electric part. As a result, the service person can access the electric part while only the first panel is detached. Further, a conventional configuration needs detachment of a plurality of panels, increases a total weight of the panels though reducing a weight of each panel, and increases the number of panels to complicate a detaching method. However, this outdoor unit eliminates the need for such a complicated detaching method, saves operation time, and improves work efficiency.

In the outdoor unit of a refrigeration apparatus according to one or more embodiments of the present invention, only detaching the first panel from the casing allows for access to the electric part. This improves work efficiency at the time of initial setting and maintenance after installment.

In the outdoor unit of a refrigeration apparatus according to one or more embodiments of the present invention, the downward-facing surface or the inclined surface is formed at the position shifting from the first region having a wide width to the second region having a narrow width. This surface functions as the handle for lifting the first panel.

The outdoor unit of a refrigeration apparatus according to one or more embodiments of the present invention has the inclined part that faces obliquely downward, enables the service person to lift the first panel by hooking a finger onto the inclined part to detach the first panel from the casing, and thus improves work efficiency.

In the outdoor unit of a refrigeration apparatus according to one or more embodiments of the present invention, when detaching the first panel from the casing, it is easier for the service person to lift the first panel by inserting a finger into the gap where the first and second panels do not overlap each other than by gripping the part where the first and second panels overlap each other. Specifically, a recess including an "overlapping part" and a "non-overlapping part" of the first and second panels is formed, and the service person inserts a finger into the "non-overlapping part" of the recess to grip part of the recess. As a result, work efficiency is improved.

The outdoor unit of a refrigeration apparatus according to one or more embodiments of the present invention enables the service person to lift the first panel by hooking a finger onto the flat part that faces vertically downward or obliquely downward to detach the first panel from the casing, and thus improves work efficiency.

In the outdoor unit of a refrigeration apparatus according to one or more embodiments of the present invention, the end of the first panel is located on the same plane as the outer contour plane of the support or laterally projects from the outer contour plane, so that the service person can grip the end of the panel and easily detach the panel from the casing.

The outdoor unit of a refrigeration apparatus according to one or more embodiments of the present invention ensures the space for hooking a finger onto the end of the first panel to detach the first panel from the casing, and thus allows the service person to easily grip the first panel.

The outdoor unit of a refrigeration apparatus according to one or more embodiments of the present invention enables the service person to lift the first panel by hooking a finger onto the side end part to detach the first panel from the casing, and thus improves work efficiency.

The outdoor unit of a refrigeration apparatus according to one or more embodiments of the present invention prevents erroneous assembling because the hook part functions for positioning of the first panel.

The outdoor unit of a refrigeration apparatus according to one or more embodiments of the present invention prevents erroneous assembling by having a different arrangement of the hook parts for positioning at the time of attachment, for example, a different space in-between, because there may be erroneous assembling when the different panels have similar forms.

DETAILED DESCRIPTION

Hereinafter, one or more embodiments of the present invention will be described with reference to the drawings.

Note that the following embodiments are specific examples of the present invention, and do not limit a technical scope of the present invention.

(1) Configuration of Refrigeration Apparatus 10

Here, a schematic configuration of a refrigeration apparatus including an outdoor unit will be described before a description of the outdoor unit.

Figure 1:
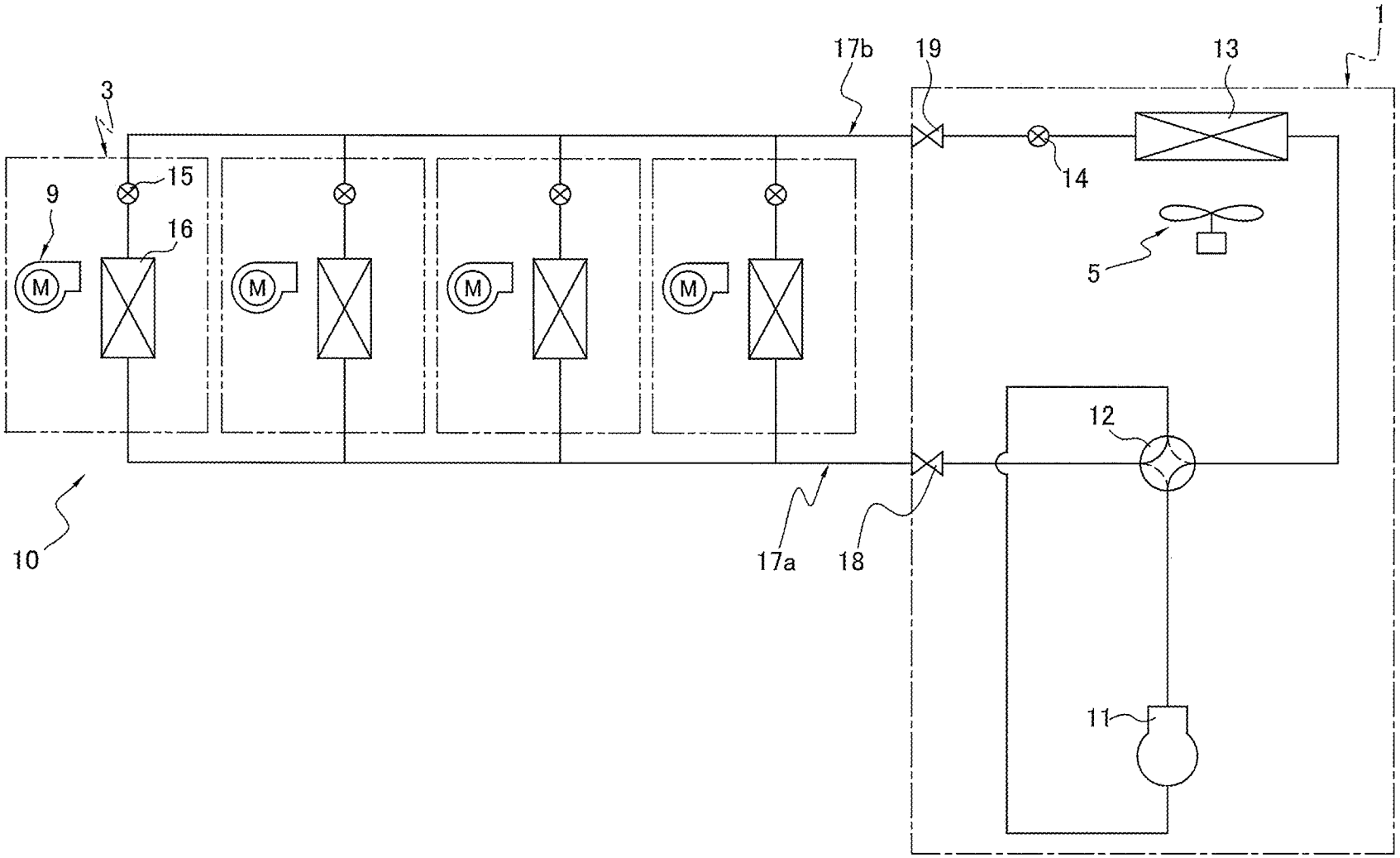
FIG. 1 is a configuration diagram of a refrigeration apparatus including an outdoor unit according to one or more embodiments of the present invention.

FIG. 1 is a configuration diagram of a refrigeration apparatus 10 including an outdoor unit 1 according to one or more embodiments of the present invention. In FIG. 1, the refrigeration apparatus 10 is a multi-type air conditioner for buildings, and a plurality of indoor units 3 is connected to one or a plurality of outdoor units 1 in parallel.

A refrigerant circuit of the refrigeration apparatus 10 mainly connects a compressor 11, a four-way switching valve 12, an outdoor heat exchanger 13, an outdoor expansion valve 14, an indoor expansion valve 15, and an indoor heat exchanger 16 in that order to constitute a vapor compression refrigeration cycle.

The outdoor unit 1 includes the compressor 11, the four-way switching valve 12, the outdoor heat exchanger 13, and the outdoor expansion valve 14, and the indoor unit 3 includes the indoor expansion valve 15 and the indoor heat exchanger 16.

A gas side connection pipe 17*a* connects the four-way switching valve 12 and the indoor heat exchanger 16, and a liquid side connection pipe 17*b* connects the outdoor expansion valve 14 and the indoor expansion valve 15.

The connection pipes 17*a* and 17*b* are disposed between the outdoor unit 1 and the indoor unit 3. In the outdoor unit 1, an accumulator and other accessories are provided, which are not illustrated.

A gas-side shutoff valve 18 and a liquid-side shutoff valve 19 are provided at terminal ends of the refrigerant circuit inside the outdoor unit 1. The gas-side shutoff valve 18 is disposed on a side of the four-way switching valve 12, and the liquid-side shutoff valve 19 is disposed on a side of the outdoor expansion valve 14. The gas side connection pipe 17*a* is connected to the gas-side shutoff valve 18, and the liquid side connection pipe 17*b* is connected to the liquid-side shutoff valve 19. The shutoff valves 18 and 19 are closed when the outdoor unit 1 and the indoor units 3 are installed. After the units 1 and 3 are installed on site and the gas side connection pipe 17*a* and the liquid side connection pipe 17*b* are connected to the shutoff valves 18 and 19, respectively, the shutoff valves 18 and 19 are opened.

The refrigerant circuit of the refrigeration apparatus 10 illustrated in FIG. 1 is a simplified version of the actual circuit. For example, the actual compressor 11 is mostly used with a combination of a variable-capacity inverter compressor that controls a number of revolutions with an inverter and a constant-capacity compressor that performs on/off control.

The outdoor unit 1 further includes an outdoor fan 5 that blows air to the outdoor heat exchanger 13 to promote heat exchange between the refrigerant and the air.

(2) Operation of Refrigeration Apparatus 10

Next, an operation of the refrigeration apparatus 10 will be described.

First, during a cooling operation, the four-way switching valve 12 is maintained as illustrated by solid lines in FIG. 1. The high-temperature, high-pressure gas refrigerant discharged from the compressor 11 flows into the outdoor heat exchanger 13 via the four-way switching valve 12, and exchanges heat with the outdoor air to be condensed and liquefied. The liquefied refrigerant passes through the outdoor expansion valve 14 that is fully opened, and flows into each indoor unit 3 via the liquid side connection pipe 17*b*. In the indoor unit 3, the refrigerant is decompressed to have a predetermined lower pressure at the indoor expansion valve 15, and the refrigerant exchanges heat with the indoor air at the indoor heat exchanger 16 to evaporate. The indoor air cooled by the evaporation of the refrigerant is blown into the room by an indoor fan 9 to cool the room. The refrigerant that has been evaporated and vaporized at the indoor heat exchanger 16 returns to the outdoor unit 1 via the gas side connection pipe 17*a* and is sucked into the compressor 11.

On the other hand, during a heating operation, the four-way switching valve 12 is maintained as illustrated by broken lines in FIG. 1. The high-temperature, high-pressure gas refrigerant discharged from the compressor 11 flows into the indoor heat exchanger 16 of each indoor unit 3 via the four-way switching valve 12, and exchanges heat with the indoor air to be condensed and liquefied. The indoor air heated by the condensation of the refrigerant is blown into the room by the indoor fan to heat the room. The refrigerant liquefied at the indoor heat exchanger 16 passes through the indoor expansion valve 15 that is fully opened, and returns to the outdoor unit 1 via the liquid side connection pipe 17*b*. The refrigerant that has returned to the outdoor unit 1 is decompressed to have a predetermined lower pressure at the outdoor expansion valve 14, and the refrigerant exchanges heat with the outdoor air at the outdoor heat exchanger 13 to evaporate. The refrigerant that has evaporated and liquefied at the outdoor heat exchanger 13 is sucked into the compressor 11 via the four-way switching valve 12.

Note that both during the cooling operation and during the heating operation, the indoor expansion valve 15 of the indoor unit 3 that is stopped is substantially closed, and little refrigerant flows into the indoor heat exchanger 16 of the indoor unit 3.

(3) Configuration of Outdoor Unit

Figure 2:
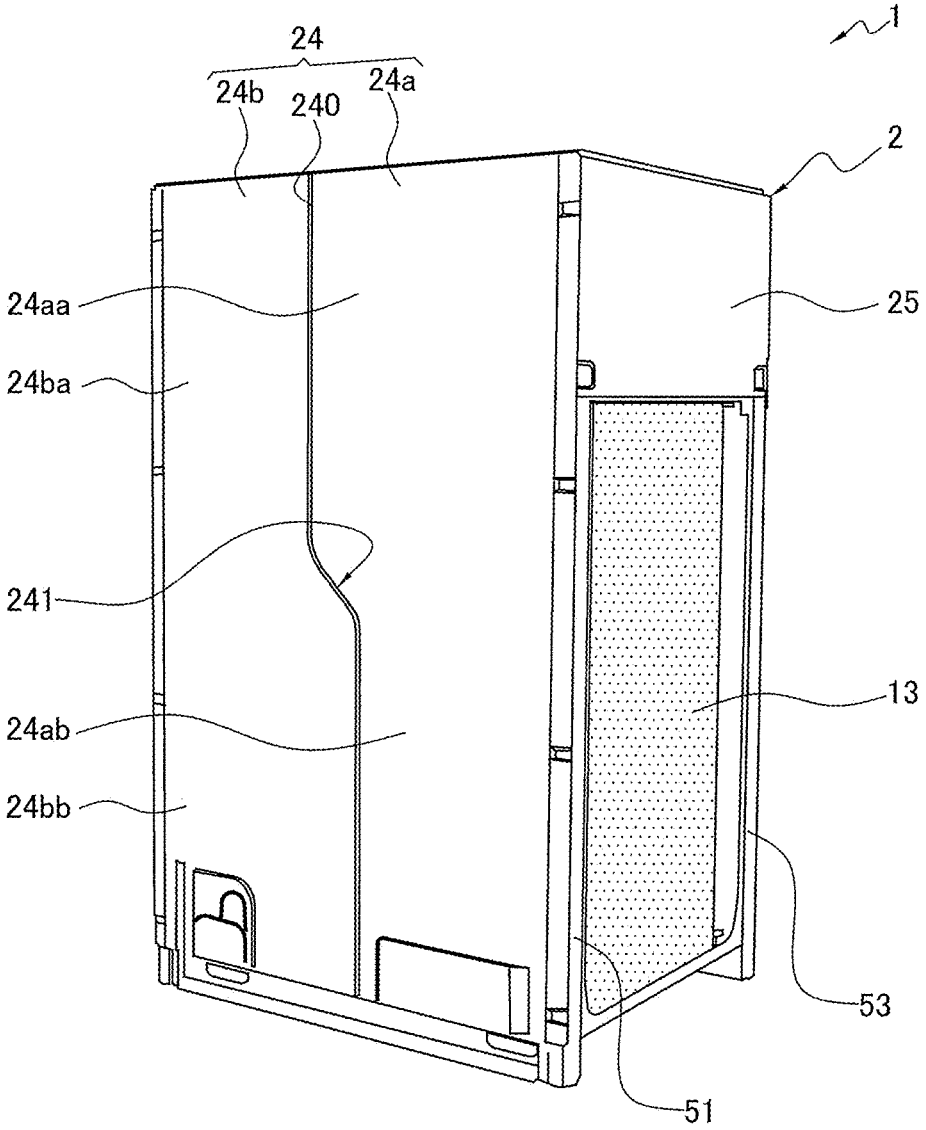
FIG. 2 is a perspective view of the outdoor unit as viewed from an angle with a view of a front panel and a right-side panel of the outdoor unit.
Figure 3:
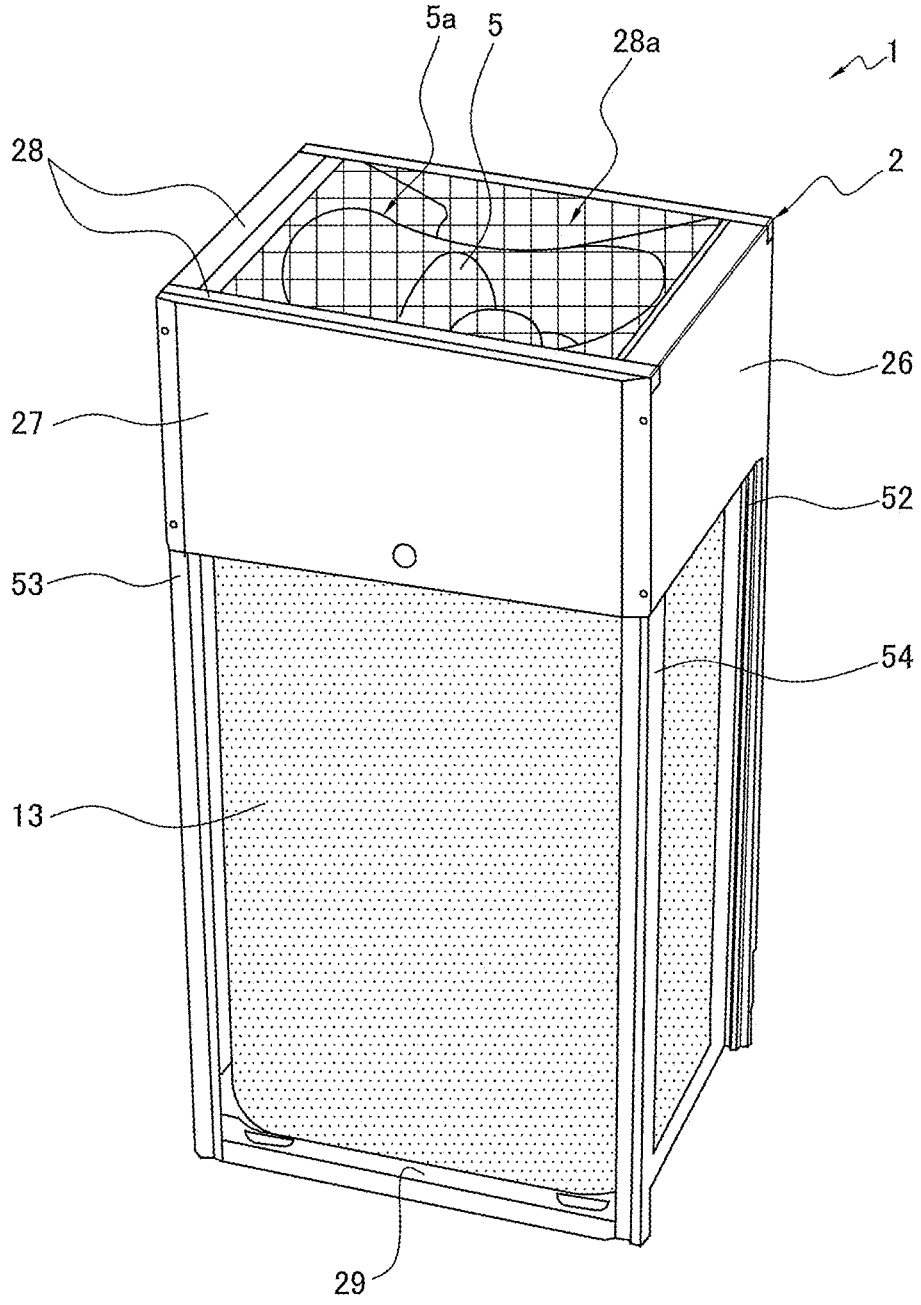
FIG. 3 is a perspective view of the outdoor unit as viewed from an angle with a view of a left-side panel, a back panel, and an upper stay of the outdoor unit.

FIG. 2 is a perspective view of the outdoor unit 1 as viewed from an angle with a view of a front panel 24 and a right-side panel 25 of the outdoor unit 1. FIG. 3 is a perspective view of the outdoor unit as viewed from an angle with a view of a left-side panel 26, a back panel 27, and an upper stay 28 of the outdoor unit 1.

In FIGS. 2 and 3, a casing 2 is formed substantially in a rectangular parallelepiped shape by the front panel 24, the right-side panel 25, the left-side panel 26, the back panel 27, the upper stay 28, and a bottom plate 29.

According to one or more embodiments, the outdoor heat exchanger 13 is disposed to be along the right-side panel 25, the left-side panel 26, and the back panel 27.

The front panel 24 includes a first panel 24*a* and a second panel 24*b*, is positioned by the casing 2, and then is fixed to the right-side panel 25 and the left-side panel 26 by screw fastening. The detailed configuration of the front panel 24 will be described later.

A region in each of the right-side panel 25 and the left-side panel 26, which is opposed to the outdoor heat exchanger 13, is opened for introducing air.

The back panel 27 is fixed to the right-side panel 25 and the left-side panel 26 by screw fastening. A region in the back panel 27, which is opposed to the outdoor heat exchanger 13, is opened for introducing air.

The upper stay 28 forms a top panel configuration with the right-side panel 25 and the left-side panel 26. The fan 5 is rotatably disposed in an upper part of the casing 2. The fan 5 is surrounded by a bell mouth 5*a*. A fan cover 28*a*, which is formed in a latticed shape made of a soft steel wire, is fitted over the upper stay 28 so as to cover the opening. The fan 5 is rotatably driven by a fan motor (not illustrated) disposed below the fan 5.

(4) Detailed Configuration of Front Panel 24

When the front panel 24 is viewed from the front (hereinafter referred to as a front view), as illustrated in FIG. 2, the first panel 24*a* and the second panel 24*b* are mounted on the casing 2 laterally side by side in the front view, in such a manner that parts of the regions adjacent to each other overlap in a thickness direction.

(4-1) First Panel 24*a*

The first panel 24*a* configures a right side part in the front view of the front panel 24. The first panel 24*a* includes a first region 24*aa* and a second region 24*ab*. The first region 24*aa* is positioned above the second region 24*ab*. Further, a width of the first region 24*aa* is formed to be wider than a width of the second region 24*ab*.

Figure 4:
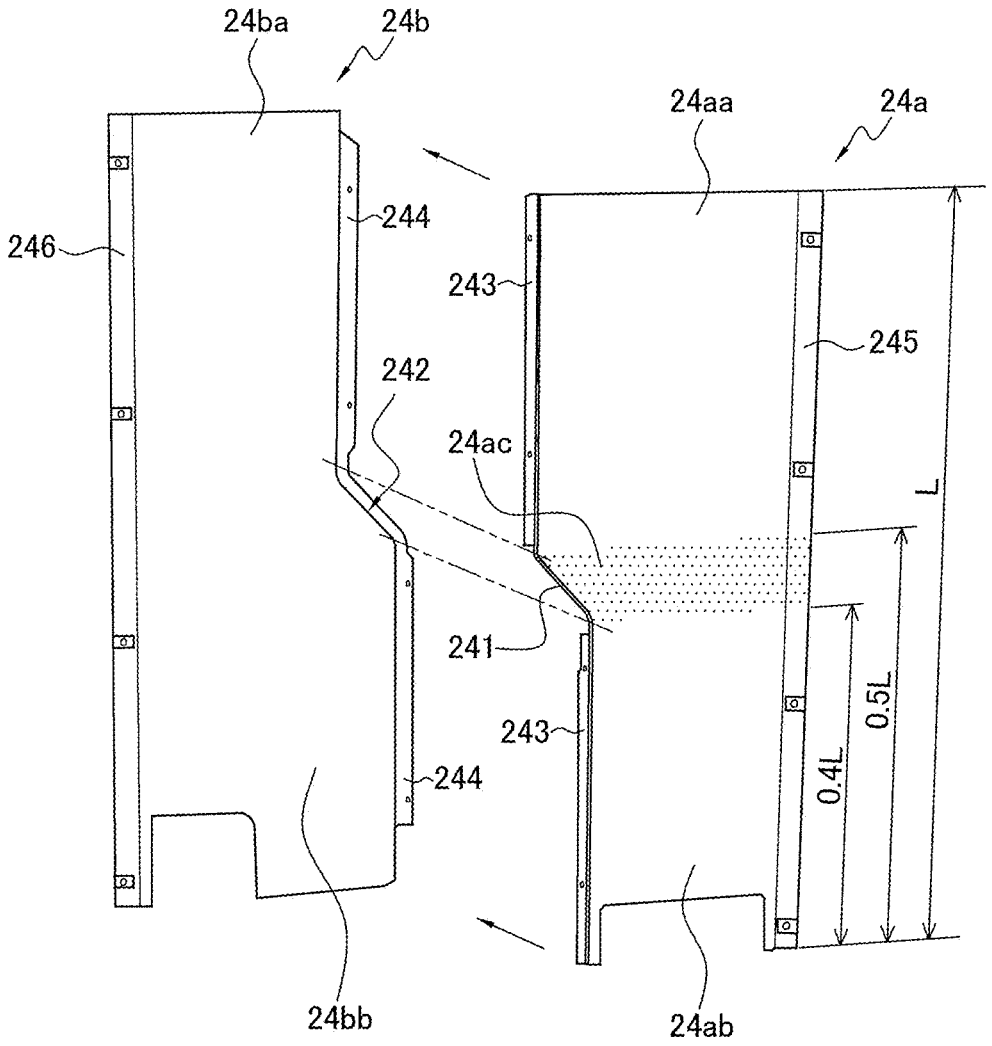
FIG. 4 is a perspective view of first and second panels of the front panel.

FIG. 4 is a perspective view of the first panel 24*a* and the second panel 24*b*. In FIG. 4, the first region 24*aa* occupies an upper part of the first panel 24*a*, the part being higher than a height position equivalent to about 45% of the full length L of the first panel 24*a* from a bottom end of the first panel 24*a*.

In a lower part of the first panel 24*a*, the part being lower than a height position equivalent to about 56% of the full length L of the first panel 24*a* from the bottom end of the first panel 24*a*, a width is reduced so as to gradually approach the width of the second region 24*ab* as the height position goes down. This part (a shaded part in FIG. 4) is referred to as a transition region 24*ac* of the first region 24*aa*.

The transition region 24*ac* is inclined in such a manner that a left end approaches a right end in the front view, and thus the width of the transition region 24*ac* becomes narrower as the height position goes down. Therefore, the left end of the transition region 24*ac* is an inclined part 241.

The inclined part 241 is positioned in a region lower than a center of the first panel 24*a* or in a region above the center of the first panel 24*a*, which is a position a service person can easily lift by hand from below, and functions as a "handle" when the first panel 24*a* is detached from the casing 2.

Figure 5:
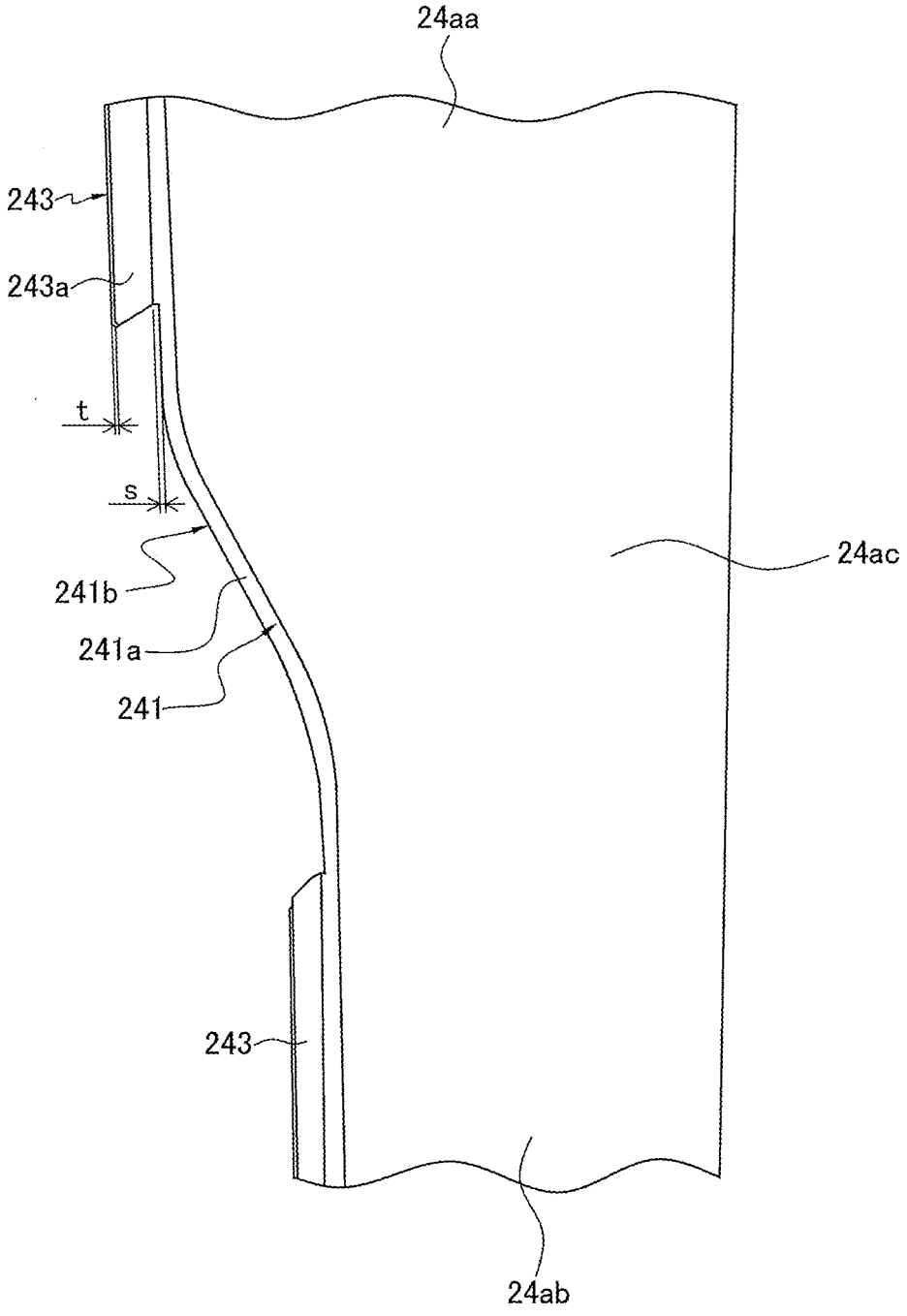
FIG. 5 is an enlarged perspective view of an inclined part.

FIG. 5 is an enlarged perspective view of the inclined part 241. In FIG. 5, the inclined part 241 has the left end of the transition region 24*ac* bent in a depth direction (panel thickness direction). Therefore, the inclined part 241 includes an inclined surface 241*a* that faces obliquely downward.

Alternatively, a left end surface of the transition region 24*ac* may be the inclined surface without bending. However, when the service person lifts the first panel 24*a* by using the inclined part 241 as the "handle", as the inclined part 241 has a larger surface, a lower pressure is applied to the hand and a sense of pressure is reduced. Therefore, the left end of the transition region 24*ac* may be bent in the depth direction (panel thickness direction).

Except the inclined part 241, the left end of the first panel 24*a* is bent in the depth direction as illustrated in FIG. 4, and then bent in a left direction to form an L shape. This part of the L shape that extends in the left direction is referred to as a first flange 243.

Further, an edge of the inclined part 241 and the first flange 243 are not on the same plane, and a level difference having a height s is provided as illustrated in FIG. 5.

(4-2) Second Panel 24*b*

As illustrated in FIG. 2, the second panel 24*b* configures a left side part in the front view of the front panel 24. The second panel 24*b* includes a first region 24*ba* and a second region 24*bb*. The first region 24*ba* is positioned above the second region 24*bb*.

Further, as illustrated in FIG. 4, since a right end of the second panel 24*b* is formed along a left end of the first panel 24*a*, a width of the first region 24*ba* is narrower than a width of the second region 24*bb*.

As a result, the first region 24*ba* occupies an upper part of the second panel 24*b*, the part being higher than a height position equivalent to about 56% of the full length of the second panel 24*b* from a bottom end of the second panel 24*b*.

The right end is inclined downward so as to be away from the left end in the front view from a height position equivalent to about 50% of the full length L of the second panel 24*b* from the bottom end of the second panel 24*b*, and a width is thus increased as the height position goes down. This inclined part is referred to as an inclined part 242, which is opposed to the inclined part 241 of the first panel 24*a*.

The right end of the second panel 24*b* is bent in the depth direction as illustrated in FIG. 4, and then bent in a right direction to form an L shape. This part of the L shape that extends in the right direction is referred to as a second flange 244.

(4-3) Overlapping Region Between First Panel 24*a* and Second Panel 24*b*

The second panel 24*b* is attached to the casing 2 before the first panel 24*a*. When the first panel 24*a* is attached, the first panel 24*a* and the second panel 24*b* overlap in the panel thickness direction in such a manner that the second flange 244 of the second panel 24*b* is on an inner side and the first flange 243 of the first panel 24*a* is on a front side. This overlapping region is referred to as an overlapping region 240.

The overlapping region 240 extends vertically downward from an upper end of the front panel 24, descends smoothly obliquely downward to the right on the way, and then extends vertically downward.

As illustrated in FIG. 5, at a part corresponding to the inclined part 241, a flange is not originally formed on the side of the first panel 24*a*, and thus a level difference having a panel thickness t of the first flange 243 is formed between the second flange 244 and the first flange 243.

Further, as illustrated in FIG. 5, the edge 241*b* of the inclined part 241 and a front surface 243*a* of the first flange 243 are not on the same plane, and the level difference having the height s is provided. Therefore, when a plane including an overlapping plane of the first flange 243 and the second flange 244 is a reference plane, a gap having a size of "s+t" is formed between the edge 241*b* of the inclined part 241 and the reference plane.

This gap "s+t" functions as the gap where the service person inserts a finger when using the inclined part 241 as the "handle". In one or more embodiments, as the panel thickness t is 0.8 mm and the level difference height s is 2 mm, the gap "s+t" is 2.8 mm.

(4-4) Positioning of First Panel 24*a* and Second Panel 24*b*

Figure 6:
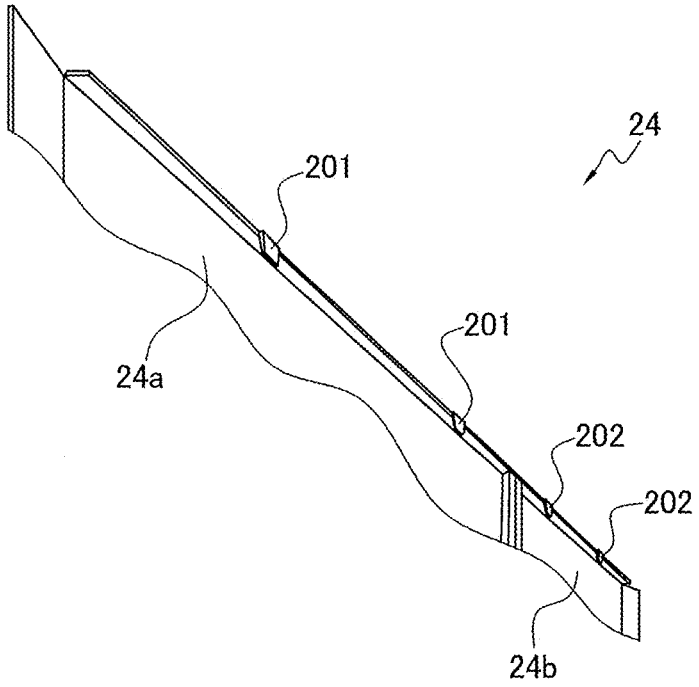
FIG. 6 is a perspective view of an upper part of the front panel as viewed from inside.
Figure 7:
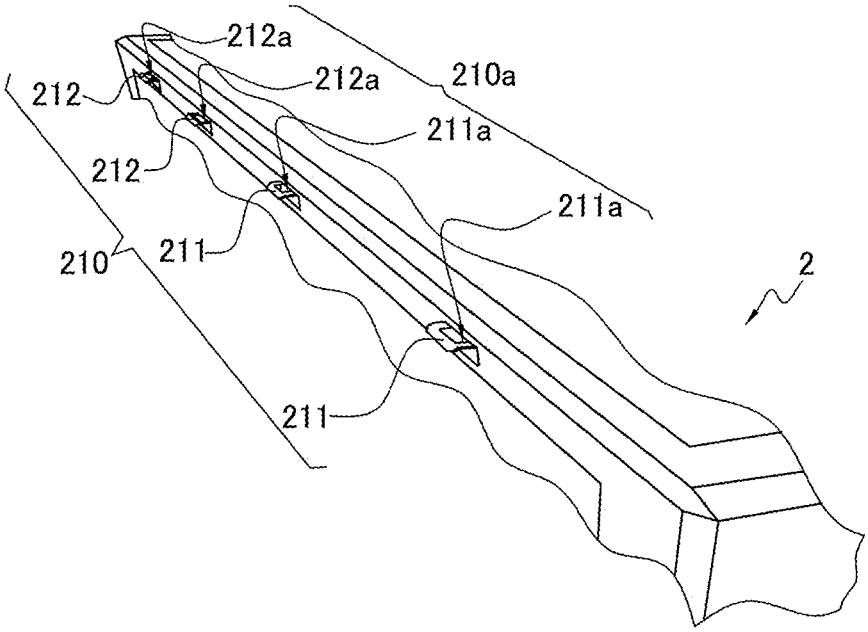
FIG. 7 is a perspective view of an upper part of a casing where the upper part of the front panel is positioned.

FIG. 6 is a perspective view of an upper part of the front panel 24 as viewed from inside. FIG. 7 is a perspective view of an upper part of the casing 2 where the upper part of the front panel 24 of FIG. 6 is positioned.

In FIG. 6, an upper end part of the first panel 24*a* is bent in the depth direction. First claws 201 protrude vertically downward from two predetermined positions of an end surface of the upper end part. An upper end part of the second panel 24*b* is similarly bent in the depth direction. Second claws 202 protrude vertically downward from two predetermined positions of an end surface of the upper end part. A gap between the two first claws 201 of the first panel 24*a* is different from a gap between the two second claws 202 of the second panel 24*b*.

In FIG. 7, four cut-and-raised parts 210 that protrude forward are formed on a front upper end part of the casing 2. The cut-and-raised parts 210 have holes 210*a* in which the claws fit.

As a front end in FIG. 7 is a right end of the casing 2 in the front view, the two cut-and-raised parts 210 at the front in FIG. 7 correspond to the first claws 201 of the first panel 24*a*. Note that the two cut-and-raised parts 210 at the front in FIG. 7 are referred to as first cut-and-raised parts 211.

As a deep end in FIG. 7 is a left end of the casing 2 in the front view, the two cut-and-raised parts 210 in the back in FIG. 7 correspond to the second claws 202 of the second panel 24*b*. Note that the two cut-and-raised parts 210 in the back in FIG. 7 are referred to as second cut-and-raised parts 212.

A gap between holes 211*a* of the two first cut-and-raised parts 211 is equal to the gap between the two first claws 201, and a gap between holes 212*a* of the two second cut-and-raised parts 212 is equal to the gap between the two second claws 202.

Therefore, the two first claws 201 of the first panel 24*a* are always positioned by the holes 211*a* of the two first cut-and-raised parts 211 of the casing 2. Similarly, the two second claws 202 of the second panel 24*b* are always positioned by the holes 212*a* of the two second cut-and-raised parts 212 of the casing 2.

(5) Positional Relationship Between First Panel 24*a* and Support 51

As illustrated in FIGS. 2 and 3, supports 51, 52, 53, and 54 are provided at vertically extending four corners of the casing 2, to support the casing 2. The supports 51, 52, 53, and 54 are formed by bending a sheet metal.

According to one or more embodiments, as viewed from the front panel 24, the support on the front right is referred to as a first support 51, the support on the front left is referred to as a second support 52, the support on the rear right is referred to as a third support 53, and the support on the rear left is referred to as a fourth support 54.

The first support 51 and the fourth support 54 have the same form, the second support 52 and the third support 53 have the same form, and the first support 51 and the second support 52 are linearly symmetric to each other. Hereinafter, the form of the supports will be described using the first support 51 as an example.

Figure 8A:
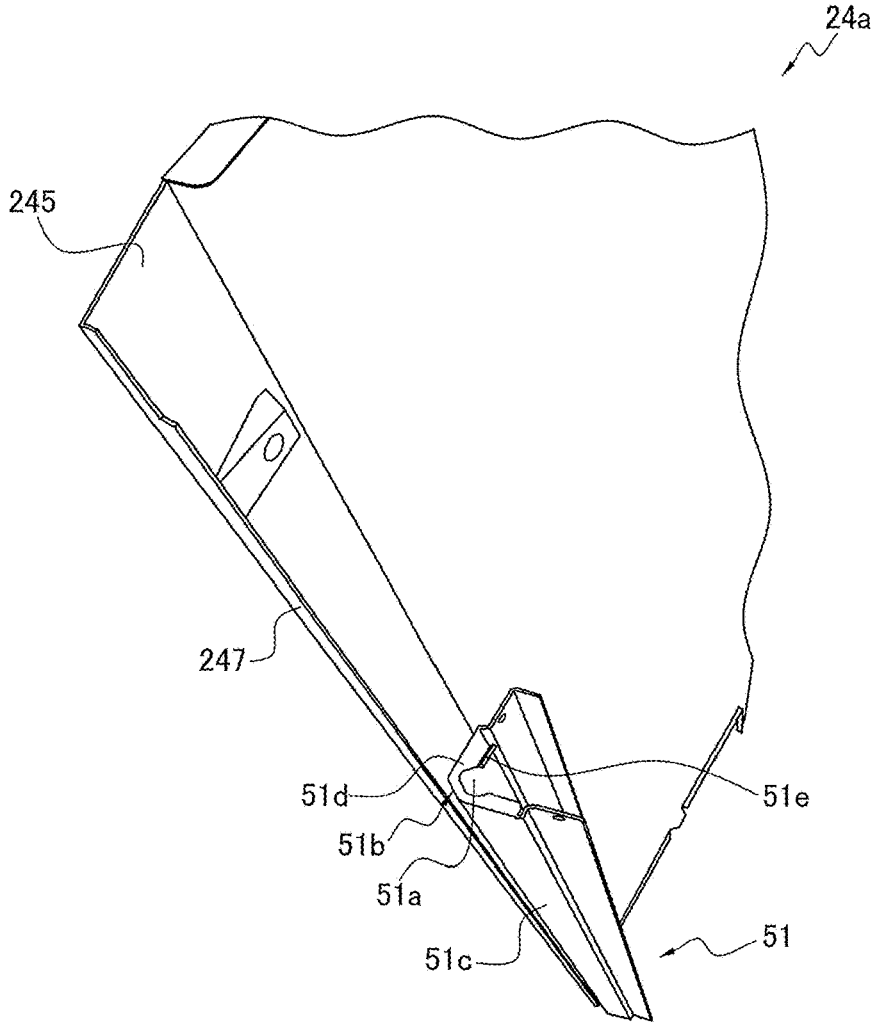
FIG. 8A is a perspective view of a first support to which the first panel is fixed.
Figure 8B:
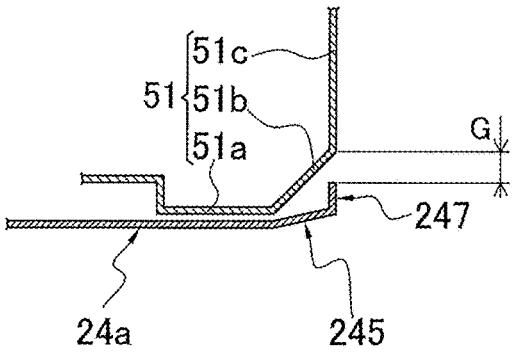
FIG. 8B is a partial cross-sectional view of the first panel and the first support, obtained by horizontally cutting the first support of FIG. 8A.

FIG. 8A is a perspective view of the first support 51 to which the first panel 24*a* is fixed. FIG. 8B is a partial cross-sectional view of the first panel 24*a* and the first support 51, obtained by horizontally cutting the first support 51 of FIG. 8A.

In FIGS. 8A and 8B, the first support 51 includes eight vertical planes that extend longitudinally (vertically). The eight vertical planes include a fixing plane 51*a* that mainly works, a corner plane 51*b*, and an outer contour plane 51*c*.

The fixing plane 51*a* is opposed to the first panel 24*a* and fixes the first panel 24*a*.

The corner plane 51*b* is adjacent to the fixing plane 51*a* and crosses the fixing plane 51*a* at an angle of 45°. As illustrated in FIGS. 8A and 8B, a side end 247 that extends in a depth direction is formed on an end part 245 of the first panel 24*a*. Therefore, the corner plane 51*b* has a function to ensure a gap G between the corner plane 51*b* and the side end 247 of the first panel 24*a* when the end part 245 of the first panel 24*a* is fixed to the fixing plane 51*a*. The gap G is where a finger is inserted when the service person grips the first panel 24*a*. In one or more embodiments, the gap G is set at about 4 mm.

The outer contour plane 51*c* is adjacent to the corner plane 51*b*, and forms an angle of 90° with respect to the fixing plane 51*a*. In one or more embodiments, in the front view in FIG. 2, the first panel 24*a* is fixed in such a manner that the end of the first panel 24*a* is positioned on the same plane as the outer contour plane 51*c*. Alternatively, the end of the first panel 24*a* may laterally project from the outer contour plane 51*c*.

The first support 51 further includes a horizontal plane 51*d* that is formed by bending upper ends of the fixing plane 51*a*, the corner plane 51*b*, and the outer contour plane 51*c* inward at an angle of 90°. The fan 5, the bell mouth 5*a*, and other assemblies that are disposed in the upper part of the casing 2 are mounted on the horizontal plane 51*d*. A protrusion 51*e* for positioning the assemblies to be mounted is provided on the horizontal plane 51*d*.

(6) Positional Relationship Between First Panel 24*a* and Electric Component Box 6

Figure 9:
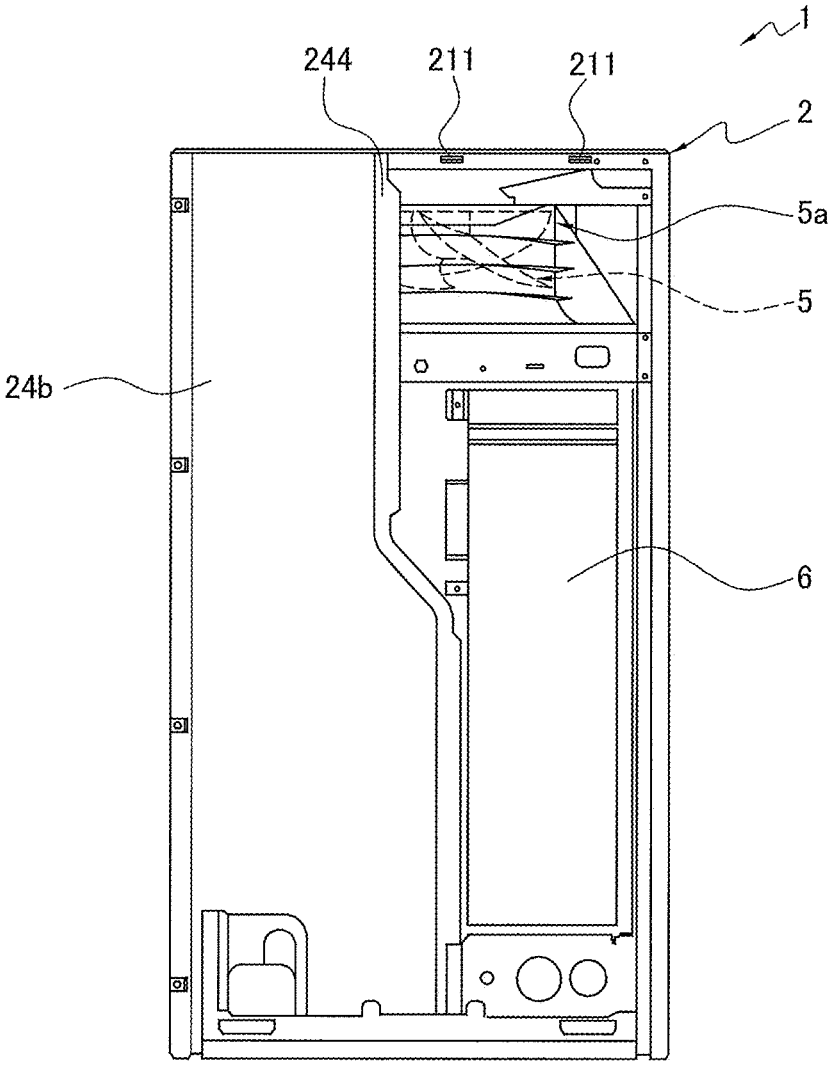
FIG. 9 is a front view of the outdoor unit when the first panel is detached from the casing.

FIG. 9 is a front view of the outdoor unit 1 with the first panel 24*a* detached from the casing 2. In FIG. 9, the electric component box 6 is disposed at a position close to the front panel 24 in the casing 2. The electric component box 6 includes, inside, a control board that controls an operation of the refrigeration apparatus 10.

As illustrated in FIG. 9, a width of the electric component box 6 is equal to or narrower than the width of the second region 24*ab* of the first panel 24*a*; only detaching the first panel 24*a* will expose the electric component box 6 to the front. Therefore, the service person can access the electric component box 6 only by detaching the first panel 24*a* without detaching the second panel 24*b* for initial setting or maintenance after installment of the outdoor unit 1, and such work is thus facilitated.

(7) Characteristics (7-1)

In the outdoor unit 1, since the front panel 24 is divided into the first panel 24*a* and the second panel 24*b*, the service person for initial setting or maintenance can detach only the first panel 24*a* from the casing 2 while the second panel 24*b* remains attached to the original position of the casing 2 when accessing the electric component box 6. As a result, the service person can access the electric component box 6 while only the first panel 24*a* is detached. Further, a conventional configuration needs detachment of a plurality of panels, increases a total weight though reducing a weight of each panel, and increases the number of panels. The service person is thus required to adopt a complicated detaching method. However, this outdoor unit 1 eliminates the need for such a complicated detaching method, reduces operation time, and improves work efficiency.

(7-2)

As the inclined part 241 that faces obliquely downward is provided near the center of the first panel 24*a* on the left end in the front view, the service person can lift the first panel 24*a* by hooking a finger onto the inclined part 241 to detach the first panel 24*a* from the casing 2. Work efficiency is thus improved.

(7-3)

When detaching the first panel 24*a* from the casing 2, the service person can lift the first panel 24*a* by inserting a finger into the gap "s+t" where the first panel 24*a* and the second panel 24*b* do not overlap. Work efficiency is thus improved.

(7-4)

The side end 247 of the first panel 24*a* and the outer contour plane 51*c* of the first support 51 are disposed on the same plane, and so the service person can grip the side end 247 of the first panel 24*a*. It is thus easy to detach the first panel 24*a* from the casing 2. Note that the side end 247 of the first panel 24*a* and the outer contour plane 51*c* of the first support 51 do not need to be disposed on the same plane, but the side end 247 may be disposed outside the outer contour plane 51*c*.

(7-5)

Since the gap for hooking a finger onto the end surface of the side end 247 of the first panel 24*a* is secured between the side end 247 of the first panel 24*a* and the first support 51, the service person can insert a finger into the gap when detaching the first panel 24*a* from the casing 2, and can easily grip the side end 247 of the first panel 24*a*.

(7-6)

The two first claws 201 of the first panel 24*a* and the two first cut-and-raised parts 211 of the casing 2 function for positioning the first panel 24*a* with respect to the casing 2. This prevents erroneous assembling.

(8) Modifications

Figure 10:
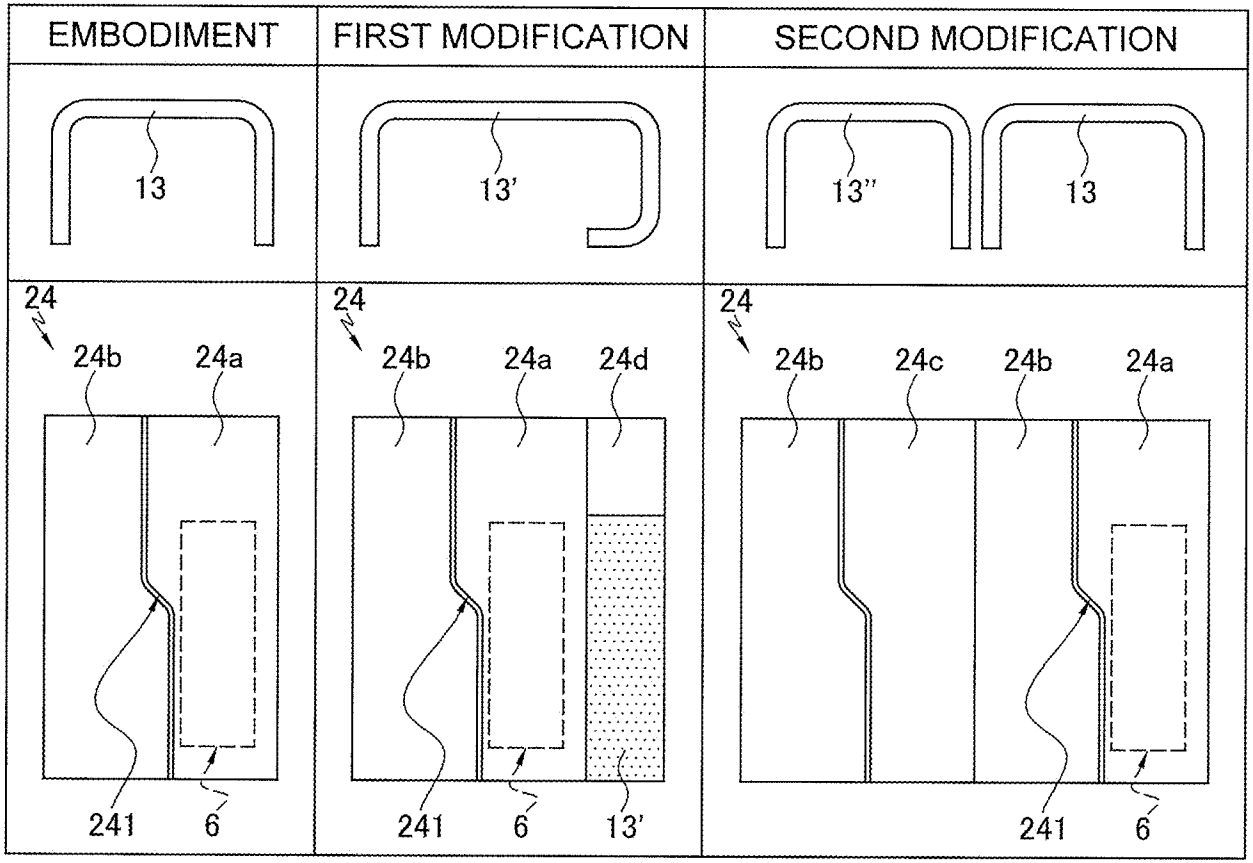
FIG. 10 is a table illustrating a relationship between a form of an outdoor heat exchanger and a form of the front panel.

FIG. 10 is a table illustrating a relationship between a form of the outdoor heat exchanger 13 and a form of the front panel 24. In FIG. 10, the left column includes a plan view of the outdoor heat exchanger 13 and a front view of the front panel 24, which are adopted in one or more embodiments. The middle column includes a plan view of an outdoor heat exchanger 13' and a front view of the front panel 24, which are adopted in a first modification. The right column includes a plan view of an outdoor heat exchanger 13 and a front view of the front panel 24, which are adopted in a second modification.

(8-1) First Modification

As illustrated in the middle column of FIG. 10, in the first modification, the outdoor heat exchanger 13' is longer in the width direction than the outdoor heat exchanger 13 of one or more embodiments, and the width of the casing 2 in the first modification is accordingly wider. An auxiliary panel 24*d* is thus attached to the left of the first panel 24*a*.

The full length of the auxiliary panel 24*d* in the height direction is substantially 30% of that of the first panel 24*a*. A lower part of the auxiliary panel 24*d* is open to expose the outdoor heat exchanger 13'.

The service person can grip the right end of the first panel 24*a* at a lower part of the first panel 24*a* with respect to the auxiliary panel 24*d* by right hand, and grip the inclined part 241 of the first panel 24*a* by left hand, for an access to the electric component box 6, to detach the first panel 24*a* from the casing 2.

(8-2) Second Modification

As illustrated in the right column of FIG. 10, in the second modification, two outdoor heat exchangers having different sizes (an outdoor heat exchanger 13" on the left is smaller than the outdoor heat exchanger 13 on the right) are laterally disposed. The width of the casing 2 is, therefore, about twice as wide as the width of the casing of one or more embodiments. As a result, still another second panel 24*b* and a third panel 24*c* having a similar form to the first panel 24*a* are required.

As the first panel 24*a* is disposed on the right in the front view, nothing prevents a grip to the right end of the first panel 24*a*. Therefore, the service person can detach the first panel 24*a* from the casing 2 by gripping the right end of the first panel 24*a* by right hand regardless of a height position and gripping the inclined part 241 of the first panel 24*a* by left hand to access the electric component box 6.

In addition, in a case where the first panel 24*a*, the second panel 24*b*, and the third panel 24*c* are detached from the casing 2, in order to reattach the first panel 24*a*, the second panel 24*b*, and the third panel 24*c* to the casing 2, the first panel 24*a* is positioned by the two first claws 201 of the first panel 24*a* and the holes 211*a* of the two first cut-and-raised parts 211 of the casing 2, which are disposed differently from other panels as illustrated in FIGS. 6 and 7. There is thus no possibility that the second panel 24*b* and the third panel 24*c* are erroneously attached to the regular position of the first panel 24*a*.

The service person can access the electric component box only by detaching the first panel, which is part of the front panel. The present invention reduces workload of the service person, and is generally useful for the outdoor unit.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 Outdoor unit
2 Casing
5 Fan
6 Electric component box (Electric part)
10 Refrigeration apparatus
24 Front panel (Panel)
24*a* First panel
24*b* Second panel
201 First claw (hook part)
202 Second claw (hook part)
241 Inclined part
241*a* Inclined surface (Flat part)
247 Side end (Side end part)
51 First support (Support)
51*c* Outer contour plane

The invention claimed is:

1. An outdoor unit of a refrigeration apparatus, comprising:

a fan that generates a flow of air passing through a heat exchanger and blows the flow of air upward;

an electric part that accommodates a group of electric components; and a casing that comprises a panel disposed at a predetermined position opposite to the electric part, wherein the panel comprises a first panel and a second panel in a lateral direction as viewed from a front view of the panel, the first panel comprises a first upper flange and a first lower flange, the first panel overlaps with the second panel at the first upper flange and the first lower flange, and does not overlap with the second panel at an interface between the first upper flange and the first lower flange, the first panel is opposed to at least part of the electric part and has a first region, a transition region, and a second region all having different height positions and widths, each of the first region, the transition region, and the second region has a width that equals a full width of the first panel at respective height positions, the first region is disposed above the second region, a width of the first region is wider than a width of the second region, the transition region is between the first region and the second region and a width of the transition region continuously decreases starting from the width of the first region where the first region transitions into the transition region and ending with the width of the second region where the transition region transitions into the second region, the first panel is detachable from the casing while the second panel remains attached to the casing, and the second panel has a third region and a fourth region having different height positions and widths.

2. The outdoor unit of claim 1, wherein a width of at least part of the first panel is equal to or wider than a width of the electric part as viewed from a side of the first panel.

3. The outdoor unit of claim 2, wherein the first panel comprises an inclined part that makes a width of the first panel become narrower as the height position goes down in the front view of the panel.

4. The outdoor unit of claim 2, wherein the first panel comprises a flat part that faces vertically downward or obliquely downward.

5. The outdoor unit of claim 2, wherein the casing further comprises a support disposed in at least one corner of the casing, and an end of the first panel is disposed on a same plane as an outer contour plane of the support or laterally projects from the outer contour plane in the front view of the panel.

6. The outdoor unit of claim 1, wherein the first panel comprises an inclined part that makes a width of the first panel become narrower as the height position goes down in the front view of the panel.

7. The outdoor unit of claim 6, wherein the first panel comprises a flat part that faces vertically downward or obliquely downward.

8. The outdoor unit of claim 6, wherein the casing further comprises a support disposed in at least one corner of the casing, and an end of the first panel is disposed on a same plane as an outer contour plane of the support or laterally projects from the outer contour plane in the front view of the panel.

9. The outdoor unit of claim 1, wherein the first panel comprises a flat part that faces vertically downward or obliquely downward.

10. The outdoor unit of claim 9, wherein the casing further comprises a support disposed in at least one corner of the casing, and an end of the first panel is disposed on a same plane as an outer contour plane of the support or laterally projects from the outer contour plane in the front view of the panel.

11. The outdoor unit of claim 1, wherein the casing further comprises a support disposed in at least one corner of the casing, and an end of the first panel is disposed on a same plane as an outer contour plane of the support or laterally projects from the outer contour plane in the front view of the panel.

12. The outdoor unit of claim 1, wherein the casing further comprise a support disposed in at least one corner of the casing, an end of the first panel is opposed to a corner of the support, and a predetermined gap is provided between the first panel and the corner of the support.

13. The outdoor unit of claim 1, wherein the first panel comprises a side end part that extends in a depth direction.

14. The outdoor unit of claim 1, wherein the first panel comprises a hook that hooks onto the casing.

15. The outdoor unit of claim 1, wherein the casing comprises a plurality of panels, one of which is the first panel, each of the plurality of panels, including the first panel, comprises a hook that hooks onto the casing, and the plurality of panels each have a different arrangement of the hook.

* * * * *